US008578741B2

(12) United States Patent
Gillo et al.

(10) Patent No.: US 8,578,741 B2
(45) Date of Patent: Nov. 12, 2013

(54) WASHING MACHINE WITH AIR TRAP

(75) Inventors: Massimiliano Gillo, Schorndorf (DE); Thomas Scharly, Weinstadt (DE); Margret Thumm-Jorge, Kernen (DE)

(73) Assignee: Whirlpool Corporation, Benton Harbor, MI (US)

( * ) Notice: Subject to any disclaimer, the term of this patent is extended or adjusted under 35 U.S.C. 154(b) by 885 days.

(21) Appl. No.: 12/640,819

(22) Filed: Dec. 17, 2009

(65) Prior Publication Data

US 2011/0146353 A1 Jun. 23, 2011

(51) Int. Cl.
*D06F 39/08* (2006.01)

(52) U.S. Cl.
USPC ..... 68/12.27; 68/12.21; 68/12.05

(58) Field of Classification Search
USPC ..... 68/12.02, 12.05, 12.21, 12.27; 8/158–159; 312/229
See application file for complete search history.

(56) References Cited

U.S. PATENT DOCUMENTS

| | | | | |
|---|---|---|---|---|
| 3,583,182 | A * | 6/1971 | Matsuura et al. | 68/23.1 |
| 4,066,094 | A | 1/1978 | Stitch | |
| 5,107,706 | A | 4/1992 | Tolf | |
| 5,964,001 | A * | 10/1999 | Johnson | 8/158 |
| 6,481,246 | B1 | 11/2002 | Johnson et al. | |
| 6,820,447 | B2 | 11/2004 | Thies et al. | |
| 7,406,843 | B2 * | 8/2008 | Thies et al. | 68/18 F |
| 2005/0091783 | A1 * | 5/2005 | Sepke et al. | 15/320 |
| 2006/0112736 | A1 | 6/2006 | Brockschmidt et al. | |

FOREIGN PATENT DOCUMENTS

| | | | | |
|---|---|---|---|---|
| DE | 2118174 | A1 | | 10/1972 |
| DE | 19646440 | A1 | | 5/1998 |
| EP | 0321769 | A1 | | 6/1989 |
| FR | 2608414 | A1 | * | 6/1988 |
| FR | 2685362 | A3 | * | 6/1993 |
| GB | 2029863 | A | | 3/1980 |
| JP | 55163414 | A | * | 12/1980 |
| JP | 5123490 | A | | 5/1993 |
| JP | 07250989 | A | * | 10/1995 |
| JP | 09173687 | A | * | 7/1997 |
| JP | 2005137645 | A | * | 6/2005 |
| WO | 2008/052979 | A1 | | 5/2008 |
| WO | 2008/052980 | A1 | | 5/2008 |
| WO | WO 2008052979 | A1 | * | 5/2008 |
| WO | WO 2008052980 | A1 | * | 5/2008 |
| WO | WO 2008119812 | A1 | * | 10/2008 |
| WO | WO 2010076148 | A1 | * | 7/2010 |

OTHER PUBLICATIONS

German Search Report for DE102010017233, Mar. 14, 2012.

* cited by examiner

*Primary Examiner* — Michael Kornakov
*Assistant Examiner* — Kevin G Lee

(57) ABSTRACT

A washing machine having a cabinet, a pressure sensor located in the cabinet, and an air trap having at least one baffle to substantially block water at the air trap. The air trap may have an inlet in communication with a sump of the washing machine and an outlet in communication with a hose coupled to the pressure sensor. The at least one baffle may be partially traversing the air trap to substantially block water from entering the outlet when the cabinet is in a horizontal orientation.

19 Claims, 5 Drawing Sheets

WASHING MACHINE WITH AIR TRAP

BACKGROUND OF THE INVENTION

Washing machines, such as clothes washers, refreshers, and non-aqueous systems, have a treating chamber, which may have a configuration of a rotating wash basket, in which laundry items are placed for treating according to a cycle of operation. The wash basket may be perforated, and may be surrounded by an imperforate tub having a sump. A liquid supply and/or recirculation system supplies liquid to the washing machine to a desired fill level in the tub. The laundry treating appliance may further have a controller communicably and operably connected with the various components of the appliance for controlling the appliance to execute the cycle of operation.

The liquid supply and recirculation system may include an air trap and a pressure sensor used to control the fill level in the tub. A typical air trap includes the pressure sensor fluidly coupled to one end of a conduit, which can include a tube or hose, the opposite end of which is open and in communication with the sump. The pressure sensor may be coupled to the controller. As liquid enters the tub, water will enter the open end of the conduit, and, as the liquid level rises, increase the air pressure in the conduit. When the air pressure reaches a predetermined value which correlates to a certain fill level, as determined by the pressure sensor, filling is ceased.

After the completion of a cycle of operation, there may still be moisture within the washing machine, such as wash basket or tub, including the sump. If the washing machine is moved from its normal operating orientation, e.g. if the washing machine is tilted from vertical, residual moisture can enter the air trap. The residual moisture can become trapped, such as by capillary action, in the conduit leading to the pressure sensor, causing negative pressure at the pressure sensor, resulting in erroneous readings from the pressure sensor, which results in improper water levels.

Air trap failure due to residual moisture can even be a problem for new washing machines. Washing machines are often tested prior to shipment by conducting a cycle of operation, which can leave residual moisture within the washing machine. If the washing machine is shipped in a horizontal position, the residual moisture may enter the air trap, leading to failure. During shipping, a washing machine may experience extreme temperature variation. The volume of air within the air trap may expand and/or contract as the temperature increases or decreases during shipping. This expansion/contraction may produce a pumping effect of the residual moisture within the washing machine left over from testing done prior to shipping. This pumping effect may be enough for the water to reach the hose, and water may become trapped in the hose by capillary effect, resulting in erroneous readings from the pressure sensor even after washing machine is places in its normal operation orientation. These problems prevent shipment of washing machines in a horizontal position. Even if washing machines are not shipped horizontally, some washing machines are assembled with a pedestal once they arrive in a household, which requires that the washing machines be tilted from vertical.

SUMMARY OF THE INVENTION

A washing machine according to one embodiment of the invention has a cabinet, a tub located in the cabinet and defining an interior and having a sump, a wash basket located within the interior of the tub and defining a laundry treating space, a pressure sensor located in the cabinet, and an air trap having at least one baffle to substantially block water at the air trap.

DESCRIPTION OF EMBODIMENTS OF THE INVENTION

Figure 1:
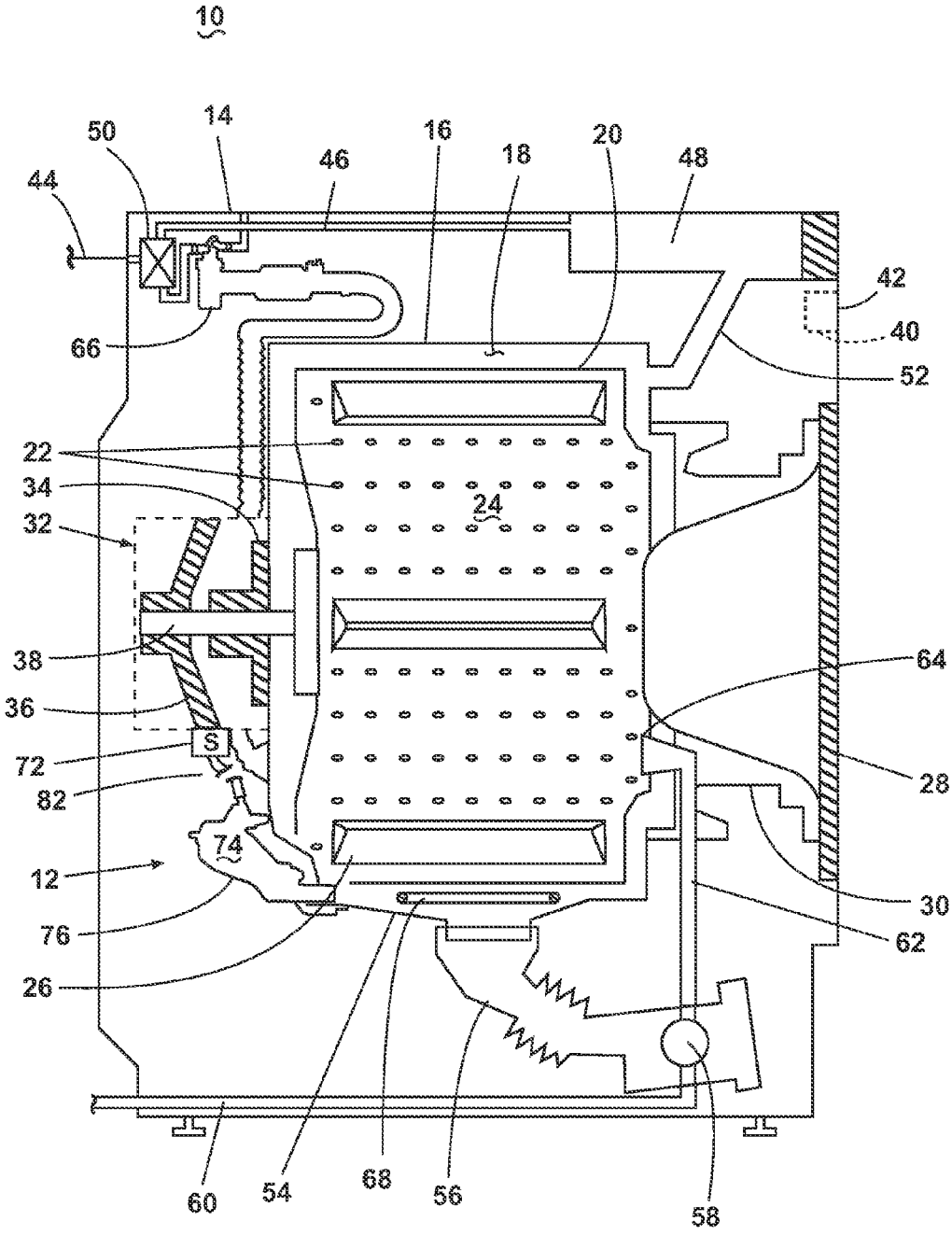
FIG. 1 is a schematic view of a washing machine having an air trap according to one embodiment of the invention.

FIG. 1 is a schematic view of a washing machine 10 having an air trap 12 according to one embodiment of the invention. The washing machine 10 is described and shown for illustrative purposes. The air trap 12 may be used with any type of washing machine in which liquid is introduced into the machine, including a top-loading machine, a front-loading machine, a vertical axis machine, a horizontal axis machine, and a combination washer/dryer. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination. As illustrated, the washing machine 10 is a front-loading, horizontal axis machine. Vertical axis and horizontal axis machines may also be distinguished by the manner in which they impart mechanical energy to the laundry. Vertical axis machines typically have a clothes mover, such as an agitator, that moves and physically contacts the laundry to impart mechanical energy. Horizontal axis machines typically lift and drop the laundry ("tumbling") to impart mechanical energy to the laundry.

The washing machine 10 described herein shares many features of a traditional automatic washing machine, which will not be described in detail except as necessary for a complete understanding of the invention. The washing machine 10 may include a cabinet 14 that houses a stationary tub 16, which defines an interior chamber 18. A rotatable drum 20 may be mounted within the interior chamber 18 of the tub 16 and may include a plurality of perforations 22, such that liquid may flow between the tub 16 and the drum 20 through the perforations 22. The drum 20 defines a laundry treatment chamber 24 sized to hold a load of laundry. The drum 20 may further include one or more lifters or baffles 26 disposed on an inner surface of the drum 20 to lift the load contained in the laundry treatment chamber 24 while the drum 20 rotates. Both the tub 16 and the drum 20 may be selectively closed by a door 28. A bellows 30 couples an open face of the tub 16 with the cabinet 14, and the door 28 seals against the bellows 30 when the door 28 closes the tub 16.

While the illustrated washing machine 10 includes both the tub 16 and the drum 20, with the drum 20 defining the laundry treatment chamber 24, it is within the scope of the invention for the washing machine 10 to include only one receptacle, with the receptacle defining the laundry treatment chamber for receiving the load to be treated.

The drum 20 may be rotated by a suitable drive mechanism, which is illustrated as a motor 32 having a stator 34 and a rotor 36 through a drive shaft 38 for selective rotation of the treating chamber 34 during a cycle of operation. The motor 32 may rotate the drum 20 at various speeds in either rotational direction.

A controller 40, such as a microprocessor-based controller with a software operating system including cycles of operation, may be communicably and operably coupled with various working components of the washing machine 10 to control the operation of the washing machine 10 to execute a cycle of operation. The controller 40 may receive input from a user through a user interface 42 for selecting a cycle of operation and controlling the operation of the washing machine 10 to implement the selected cycle of operation. The user interface 42 may be provided on the exterior of the cabinet 12 and may include one or more knobs, switches, displays, and the like for communicating with the user. The cycle of operation may be selected manually by the user through the user interface 42 or automatically based on one or more conditions determined by the controller 40.

The washing machine 10 may further include a liquid supply and/or recirculation system. Liquid, such as water or water with a wash aid, may be supplied to the washing machine 10 from a water supply 44, such as a household water supply. A supply conduit 46 may fluidly couple the water supply 44 to a treatment dispenser 48. An inlet valve 50 may control flow of the liquid from the water supply 44 and through the supply conduit 46 to the treatment dispenser 48. A dispensing conduit 52 may fluidly couple the treatment dispenser 48 with the tub 16.

Liquid that flows from the treatment dispenser 46 through the dispensing conduit 50 to the tub 16 typically enters a space between the tub 16 and the drum 20 and may flow by gravity to a sump 54 formed in part by a lower portion of the tub 16. The sump 54 may also be formed by a sump conduit 56 that may fluidly couple the lower portion of the tub 16 to a pump 58.

The pump 58 may direct fluid to a drain conduit 60, which may drain the liquid from the washing machine 10, or to a recirculation conduit 62, which may terminate at a recirculation inlet 64. The recirculation inlet 64 may direct the liquid from the recirculation conduit 62 into the drum 20. The recirculation inlet 64 may introduce the liquid into the drum 20 in any suitable manner, such as by spraying, dripping, or providing a steady flow of the liquid.

The liquid supply and recirculation system may optionally include one or more devices for heating the liquid such as a steam generator 66 and/or a heating element 68. The steam generator 66 may be provided to supply steam to the treating chamber 24, either directly into the drum 20 or indirectly through the tub 16 as illustrated. The valve 50 may also be used to control the supply of water to the steam generator 66. The steam generator 66 is illustrated as a flow through steam generator, but may be other types, including a tank type steam generator. Alternatively, the heating element 68 may be used to generate steam in place of or in addition to the steam generator 66. The heating element 68 may be located in the sump 54. The steam generator 66 may be controlled by the controller 40 and may be used to heat to the load as part of a treating cycle, much in the same manner as heating element 68. The steam generator 66 may also be used to introduce steam to treat the load as compared to merely heating the load.

The liquid supply and/or recirculation system further includes a pressure sensor 72 which, in cooperation with the air trap 12, is used to control the liquid level in the tub 16. The air trap 12 is located within the cabinet 14 and fluidly couples the pressure sensor 72 with the sump 54. The air trap 12 may be part of a conduit 74 that fluidly couples the pressure sensor 72 with the sump 54. As illustrated, the conduit 74 includes an air trap housing 76 fluidly coupled to the sump 54 and a hose 82 fluidly coupling the air trap housing 76 to the pressure sensor 72.

The controller 40 may receive data from the pressure sensor 72 and may provide a command, based on the received data, to one or more of the working components to execute a desired operation of the washing machine 10. For example, upon receiving data from the pressure sensor 72 that indicates the liquid level is at or near a desired level, the controller 40 may command the inlet valve 50 to close, the motor 32 to begin rotating the drum, the pump 58 to begin pumping liquid through the recirculation conduit 62, and/or the heating element 68 to begin heating the liquid. The pressure sensor 72 may be a pressure switch, whereby the switch would open or close once a predetermined pressure is measured.

Additionally, the liquid supply and recirculation system may differ from the configuration shown in FIG. 1, such as by inclusion of other valves, conduits, wash aid dispensers, sensors, such temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

Figure 2:
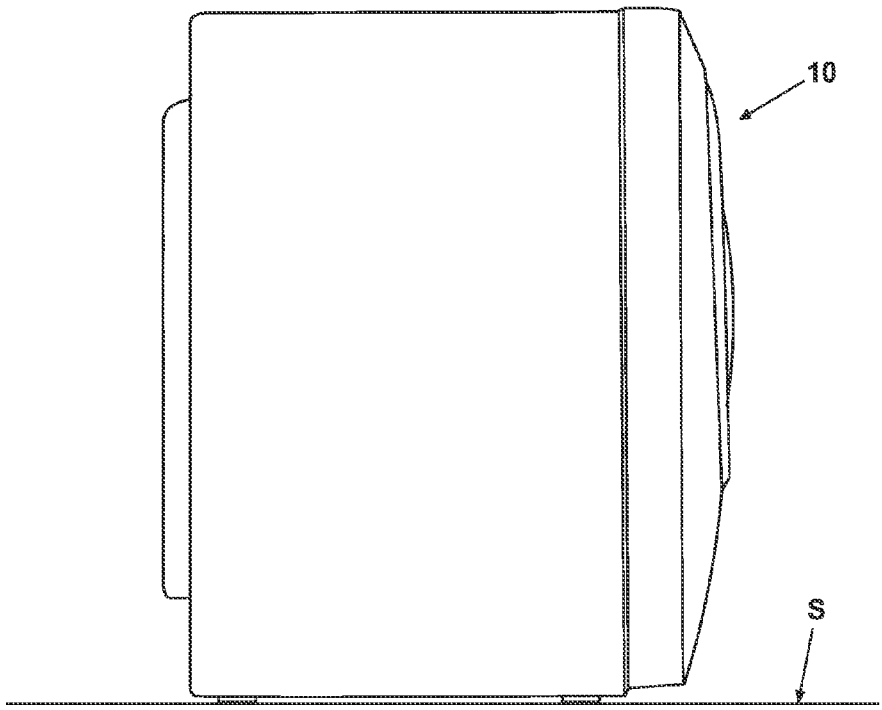
FIG. 2 shows one example of the washing machine in a normal use position for normal operation of the washing machine to conduct a cycle of operation.

FIG. 2 shows one example of the washing machine 10 in a normal use position for normal operation of the washing machine 10 to conduct a cycle of operation. During normal operation of the washing machine 10, as long as the washing machine is in the normal use position, water in the air trap 12 will have a tendency to drain into the sump 54, as shown in FIG. 1. In the illustrated normal use position, the washing machine 10 is in a vertical orientation with respect to a ground surface S. While the ground surface S is shown as being substantially horizontal, it is understood that the ground surface S can deviate from horizontal while still supporting the washing machine 10 in what would be considered to be a normal use position.

Figure 3:
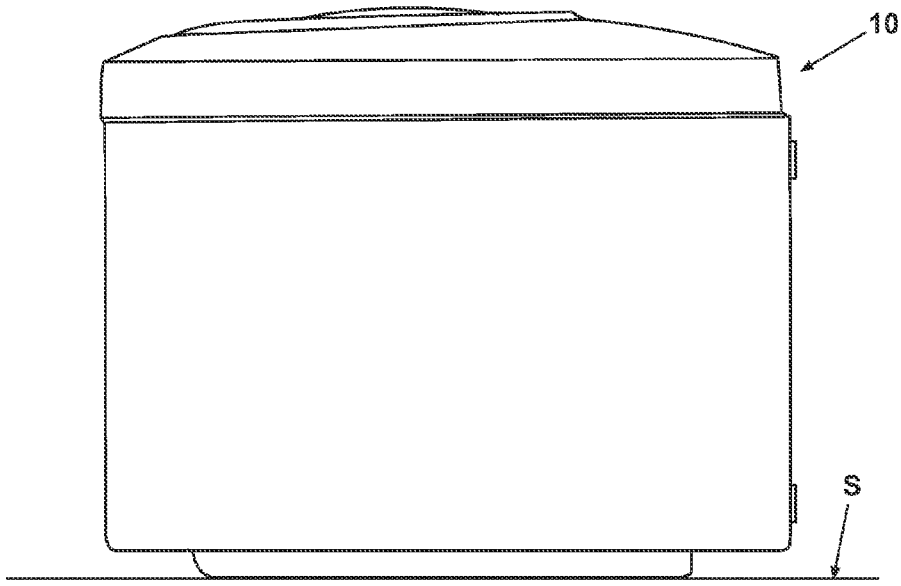
FIG. 3 shows one example of the washing machine in a non-use position during which the washing machine is typically not operated.

FIG. 3 shows one example of the washing machine 10 in a non-use position during which the washing machine 10 is typically not operated. In FIG. 3, the washing machine is in a horizontal orientation with respect to the ground surface S. The washing machine 10 may be in the horizontal orientation, for example, during shipping or during assembly with a pedestal. In the horizontal orientation, water in the sump 54 will have a tendency to drain into the air trap 12, and any water in the air trap 12 will have a tendency to remain in the air trap 12.

Figure 4:
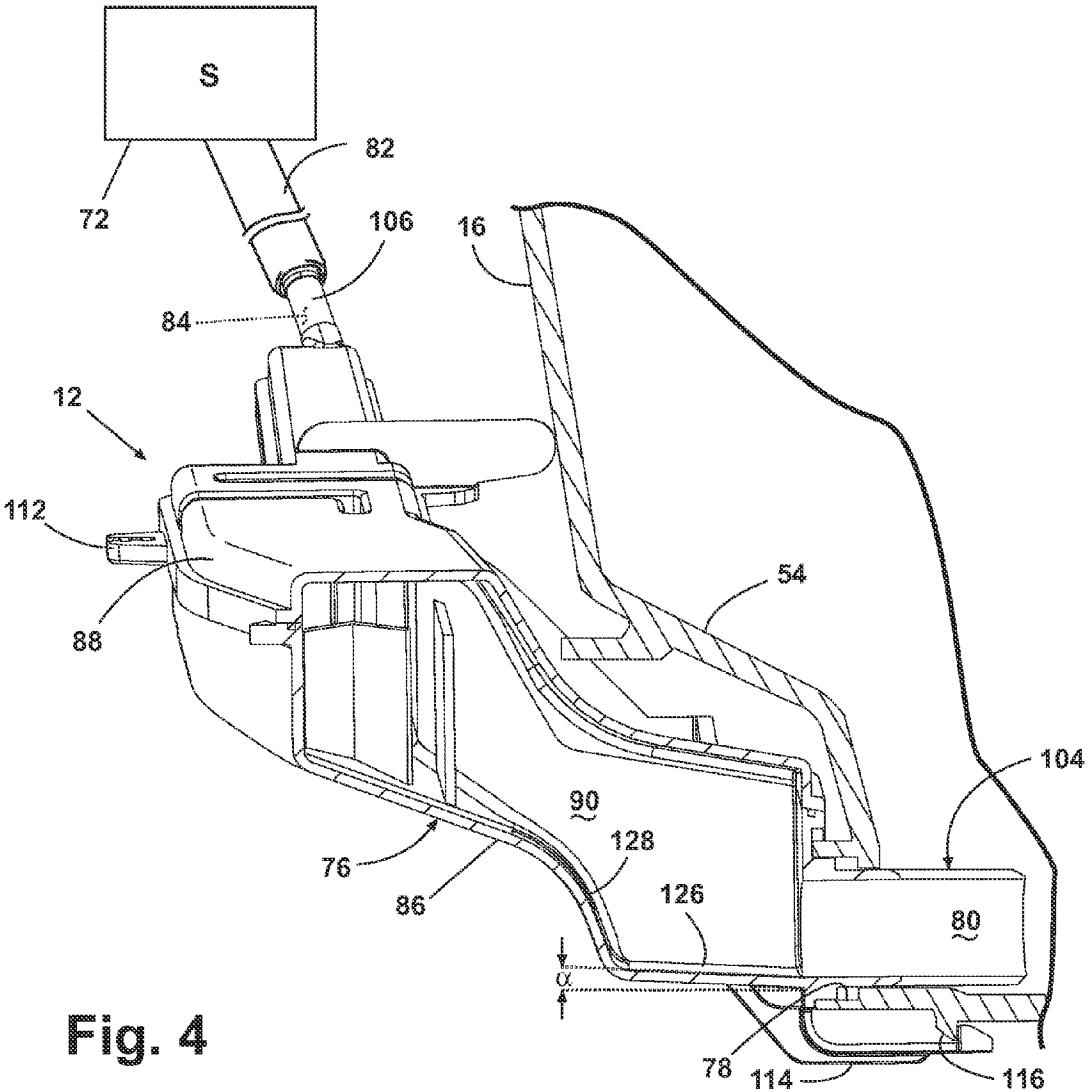
FIG. 4 is a close-up view of the air trap from FIG. 1, with a portion of the air trap and a tub of the washing machine shown in section.

Other non-use positions include those in which the washing machine 10 is in a tilted orientation, where the washing machine 10 is tilted from the vertical orientation shown in FIG. 4, but not tilted to such as extent that it is in the horizontal orientation of FIG. 3. The washing machine 10 may be in the tilted orientation, for example, during shipping or, once the washing machine 10 is installed in a home, moving the washing machine 10 for cleaning the area around it.

Figure 5:
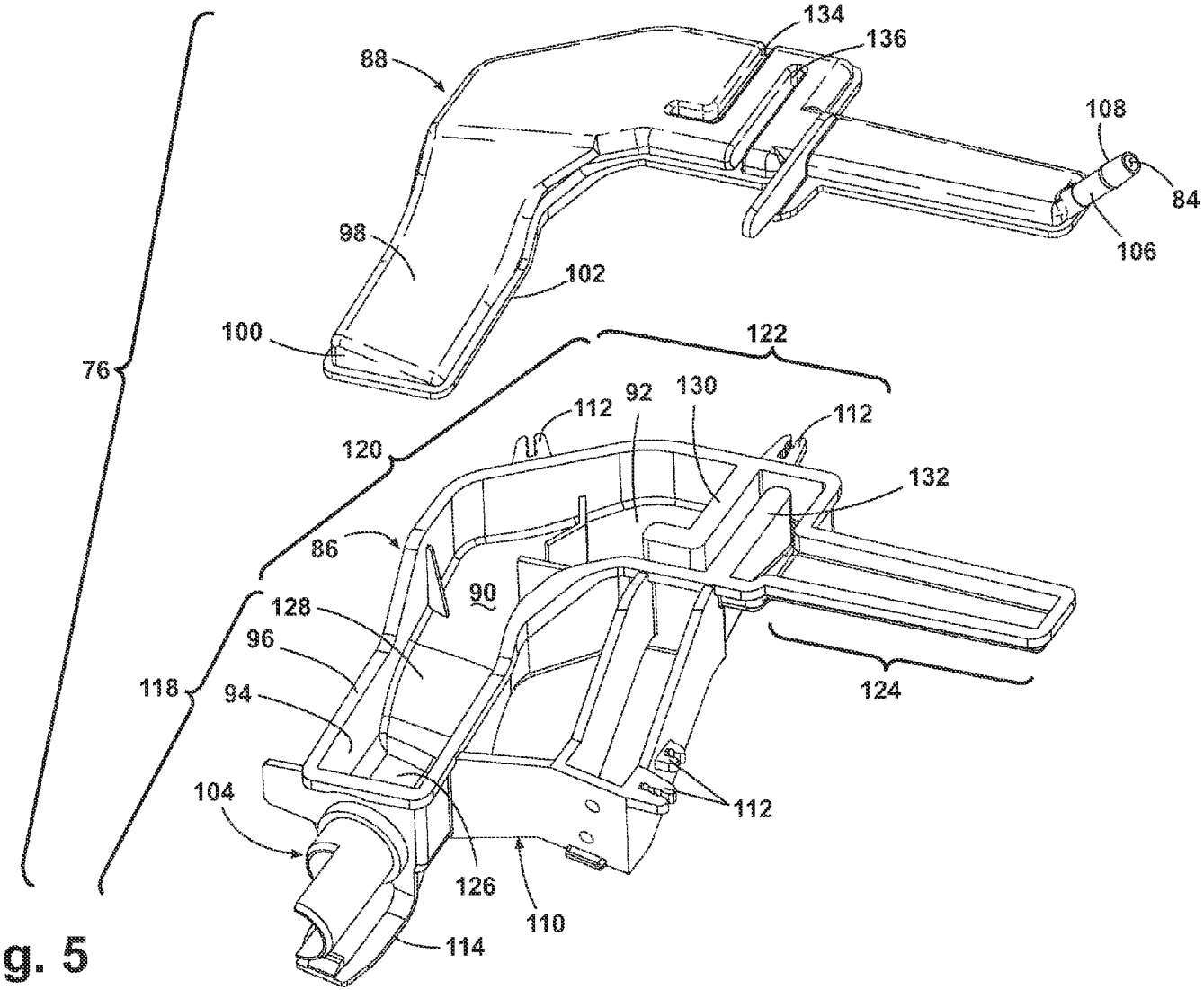
FIG. 5 is an exploded view of the air trap from FIG. 4.

FIGS. 4 and 5 show one embodiment of an air trap 12 according to the present invention, with FIG. 4 showing the air trap 12 and a portion of the tub 16 shown in section and in the normal use position of the washing machine 10, and FIG. 5 being an exploded view of the air trap housing 76. As illustrated, the air trap housing 76 has an inlet 80 fluidly coupled to the sump 54 and an outlet 84 fluidly coupled to the pressure sensor 72 by the hose 82.

The air trap housing 76 comprises a housing body 86 and a housing cover 88 that is coupled to the housing body 86 to define a chamber 90 therebetween. The housing body 86 includes a bottom wall 92 and an irregularly-shaped peripheral side wall 94 extending from the bottom wall 94 and having a free upper edge 96. The housing cover 88 includes a top wall 98 and an irregularly-shaped peripheral side wall 100 extending from the top wall 98 and having a free lower edge 102. The walls 98, 100 of the housing cover 88 may complement the shape and contour of the walls 92, 94 of the housing body 86. When the air trap housing 76 is assembled, the lower edge 102 of the housing cover 88 mates with the upper edge 96 of the housing body 86.

A tub fitting 104 is provided on the housing body 86 and defines the inlet 80 to the air trap 12. The tub fitting 104 extends through an aperture 78 formed in the tub 16, for example, formed near the sump 54.

A hose fitting 106 is provided on the housing cover 88 and defines the outlet 84 from the air trap 12. The hose fitting 106 is coupled with the hose 82 and can have one or more ridge(s) 108 thereon to receive an end of the hose 82 in a press-fit fashion. Alternatively, the hose fitting 106 may have other coupling arrangements for attaching the hose 82, such as a compression clamp or threaded fitting.

The air trap housing 76 also includes one or more mechanical interfaces for securing the air trap housing within the cabinet 12 of the washing machine 10. As illustrated, the housing body 86 is provided with a support frame 110 extending outwardly from the peripheral side wall 94, one or more grip(s) 112 on either the peripheral side wall 94 or the support frame 110, and a spring clip 114 extending from the bottom wall 92 adjacent the tub fitting 104. The support frame 110 and grips 112 may be used to position and mount the air trap housing 76 within the cabinet 12 in relation to other components of the washing machine 10 and may also serve to reinforce and/or stabilize the air trap housing 76. The spring clip 114 attaches to an interface feature 116 on the tub 16 and prevents the tub fitting 104 from sliding out of the aperture 78 in the tub 16. The mechanical interfaces 110, 112, 114 may be separately attached to the air trap housing 76, or integrally formed therewith. In this embodiment, the support frame 110, clamps 112, and spring clip 114 are integrally molded with the housing body 86.

Referring to FIG. 5, the air trap 12 includes four sections in series between the inlet 80 and the outlet 84; an inlet section 118, a sloped section 120, a baffled section 122, and an outlet section 124. Each section may have accompanying changes in the shape, contour, or dimensions of the air trap housing 76.

The inlet section 118 is in direct fluid communication with the inlet 80 and is adjacent the sump 54 and includes at least a portion of the tub fitting 104 and an inlet portion 126 of the bottom wall 92. The inlet portion 126 may be inclined an angle $\alpha$ from horizontal when the washing machine 10 is in a vertical orientation for normal operation such that water in the conduit 76 will drain into the sump 54. The angle $\alpha$ may be greater than 0°, for example, approximately 3°.

The sloped section 120 is in direct fluid communication with the inlet section 118 and includes a sloped portion 128 of the bottom wall 92. When the washing machine 10 is in the normal use position as shown FIG. 4, the sloped section 120 is vertically higher than the inlet section 118, and water will initially fill the inlet section 118. The sloped portion 128 partially defines the volume of the inlet section 118 and helps to prevent water from reaching the hose 82.

The baffled section 122 is in direct fluid communication with the sloped section 120 and includes at least one baffle 130, 132 to block water that enters the air trap housing 76 from the sump 54. The at least one baffle 130, 132 partially traverses the chamber 90 to substantially block water from reaching the hose 82 if the washing machine 10 is in the non-use position (FIG. 3).

As illustrated, a first baffle 130 and a second baffle 132 are provided on the housing body 86 of the air trap housing 76. The first and second baffles 130, 132 are spaced from each other, and each traverses a different portion of the chamber 90. The first baffle 130 is L-shaped, and extends from one side of the peripheral side wall 94 of the housing body 86 along the bottom wall 92. The second baffle 132 is straight, and extends from an opposite side of the peripheral side wall 94 than the first baffle 130, and along the bottom wall 92. With respect to the inlet 80 of the air trap housing 76, the second baffle 132 is "downstream" of the first baffle 130, meaning that fluid passing from the inlet 80 to the outlet 84 encounters the second baffle 132 after encountering the first baffle 130.

The housing cover 88 may have formations that complement the baffles 130, 132. As illustrated, the housing cover 88 includes a first baffle formation 134 and a second baffle formation 136. The first baffle formation 134 complements the first baffle 130, and is L-shaped and extends from one side of the peripheral side wall 100 of the housing cover 88 along the top wall 98. The second baffle formation 134 complements the second baffle 132, and is straight and extends from an opposite side of the peripheral side wall 100 than the first baffle formation 134, and along the bottom wall top wall 98. When the air trap housing 76 is assembled, the baffles 130, 132 mate with the baffle formations 134, 136. A seal (not shown) may be provided between the baffles 130, 132 and the baffle formations 134, 136 to ensure fluid-tight mating of the baffles. Alternately, the baffle formations may be eliminated, and the baffles 130, 132 may mate with or contact the top wall 98 of the housing cover 88.

The outlet section 184 is in direct fluid communication with the baffled section 122 and includes at least a portion of the outlet 84 and the hose fitting 106. When the washing machine 10 is in the normal use position as shown FIG. 4, the outlet section 184 is vertically higher than the inlet section 118, the sloped section 122, and the baffled section 122, with the hose fitting 106 and outlet 84 arranged at the highest end of the outlet section 184.

Figure 6:
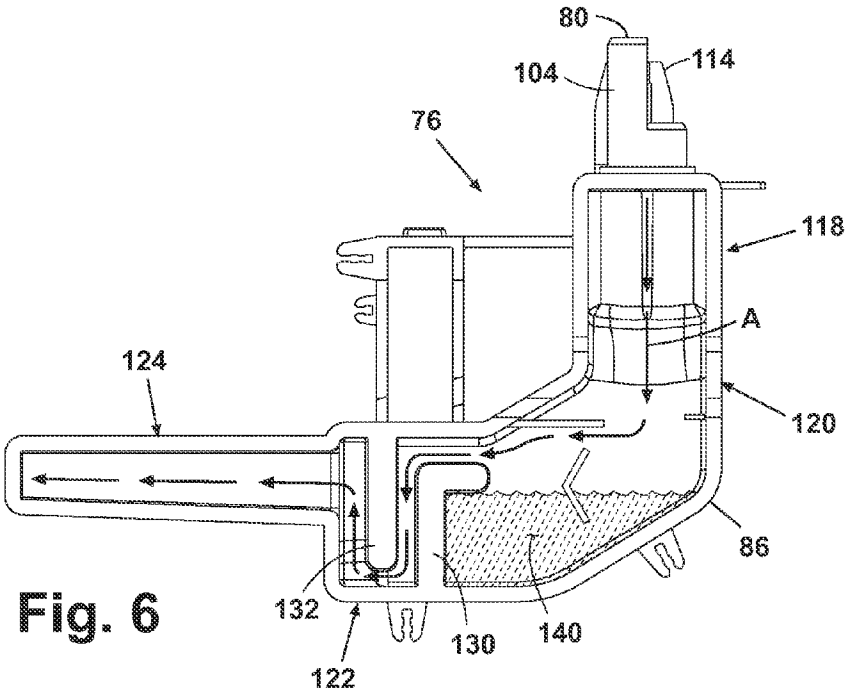
FIG. 6 shows the orientation of the air trap of FIG. 1 when the washing machine is in the non-use position shown in FIG. 3, and illustrates a reservoir for water within the air trap, with a housing cover of the air trap removed for clarity.

FIG. 6 shows the orientation of the air trap 12 when the washing machine 10 is in the non-use position or horizontal orientation shown in FIG. 3. In the horizontal orientation, the outlet section 124 of the air trap housing 76 may be vertically lower than the inlet section 118, the sloped section 122, and the baffled section 122. Therefore, any residual water left in the sump 54 after a cycle of operation that enters the inlet 80 will tend to move toward the outlet section 124. However, the baffles 130, 132 substantially block water from entering the outlet section 124 when the cabinet 12 is in the horizontal orientation. The phrase "substantially block" is not meant to imply that all water is prevented from passing the baffles 130, 132. Rather, at least enough water is blocked such that functionality of pressure sensor 72 is not compromised.

In the horizontal orientation, the air trap 12 includes a reservoir 140 defined in part by the first baffle 130. The reservoir 140 may be further defined by the portions of the housing body 86 and housing cover 88 adjacent the first baffle 130. The reservoir 140 has an effective volume, which is designed to be equal to or greater than an expected amount of residual water in the sump 54 after the washing machine 10 has conducted a cycle of operation. For example, the effective volume of the reservoir 140 may be at least 20 mL if it is expected that approximately 20 mL of residual water will be left in the sump 54 after a cycle of operation. In other examples, the effective volume of the reservoir 140 may be at least 25 mL or at least 30 mL if it is expected that approximately 25 mL or 30 mL, respectively, of residual water will be left in the sump 54 after a cycle of operation.

Figure 7:
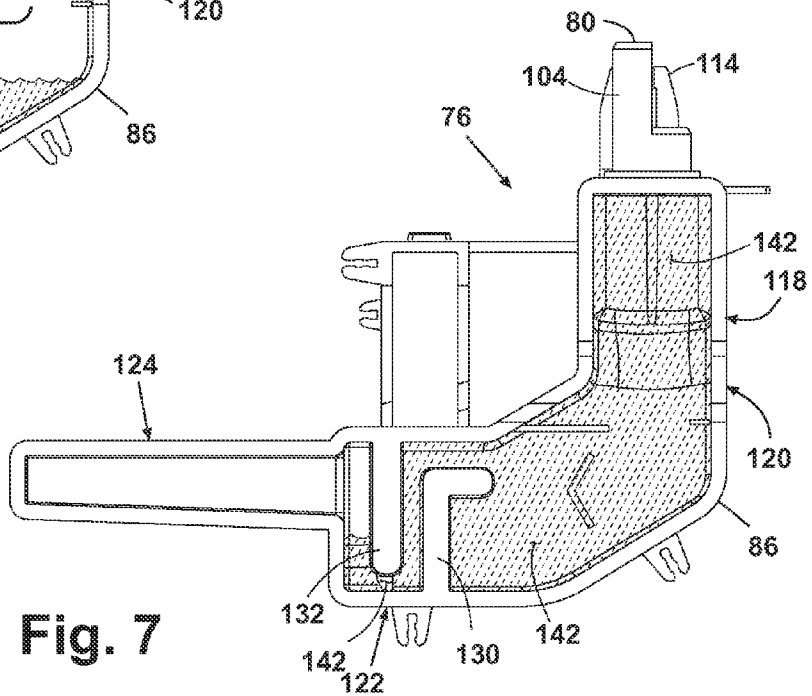
FIG. 7 shows the orientation of the air trap of FIG. 1 when the washing machine is in the non-use position shown in FIG. 3, and illustrates a fail-safe reservoir for water within the air trap, with a housing cover of the air trap removed for clarity.

Referring to FIG. 7, a fail-safe reservoir 142 may also be provided to ensure that water will not reach the outlet section 124 or hose 82 (FIG. 4) even if a larger than expected amount of water enters the air trap housing 76, i.e. larger than the effective volume of the reservoir 140. The fail-safe reservoir 142 is defined in part by the second baffle 132. The fail-safe reservoir 142 may be further defined by the portions of the housing body 86 and housing cover 88 adjacent the second baffle 132, including the first baffle 130. The fail-safe reservoir 142 is larger than and may encompass the reservoir 140. The effective volume of the fail-safe reservoir 142 may be approximately 108 mL.

As indicated by arrows A in FIG. 6, air may traverse the air trap housing 76 when the washing machine is in the non-use position (FIG. 3) since the baffles 130, 132 maintain an open air path through air trap housing 76 even when reservoir 140 is substantially full with water. This helps to prevent the pumping effect from temperature variation during shipping. If the fail-safe reservoir 142 is full, the air path through the air trap housing 76 may not be open. In the case of extreme temperature changes often experienced during shipping, water may be pulled into the outlet section 124, but will not enter the hose 82 (FIG. 4). The baffles 130, 132 may be sized and positioned such that the air pressure in the outlet section 124 resulting from the temperature variations will be equalized with the water pressure and at least prevent liquid from entering the hose 82 if not from entering the outlet section 124. This may also prevent air from passing out of the outlet section 124 and around the baffles 130, 132. The baffles 130, 132 may be sized and positioned such that liquid is allowed to drain out of the air trap 12 when the washing machine is placed in the normal use position (FIG. 2).

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A washing machine comprising:

a cabinet;

a tub located in the cabinet and defining an interior and having a sump;

a wash basket located within the interior of the tub and defining a laundry treating space;

a pressure sensor located in the cabinet; and a conduit fluidly coupling the sump to the pressure sensor and comprising:

an air trap housing having a top wall and a bottom wall connected by opposing walls to define a chamber between the sump and the pressure sensor; and at least one baffle extending from the top wall to the bottom wall, and partially extending from one of the opposing walls toward the other of the opposing walls to define a gap therebetween and to substantially block water that enters the chamber from the sump at the air trap housing.

2. The washing machine according to claim 1 wherein the conduit at least partially comprises a hose having one end coupled with the pressure sensor.

3. The washing machine according to claim 1, and further comprising multiple baffles extending from the top wall to the bottom wall and partially extending from one of the opposing walls toward the other of the opposing walls to substantially block water that enters the chamber from the sump at the air trap housing.

4. The washing machine according to claim 3 wherein at least one of the baffles extends from a different opposing wall then at least one other of the baffles.

5. The washing machine according to claim 1 wherein the at least one baffle comprises an L-shape.

6. The washing machine according to claim 1 wherein the conduit has an inlet portion adjacent the sump, and the inlet portion is inclined from horizontal when the washing machine is in a vertical orientation for normal operation such that water in the conduit will drain into the sump.

7. The washing machine according to claim 1 wherein the washing machine comprises one of a horizontal axis washing machine and a vertical axis washing machine.

8. The washing machine according to claim 7 wherein the washing machine is a horizontal axis washing machine and further comprises at least one lifter located within the laundry treating space.

9. The washing machine according to claim 1 wherein the air trap housing comprises a reservoir defined in part by the at least one baffle, and the effective volume of the reservoir is greater than an expected amount of residual water in the sump after the washing machine has conducted a cycle of operation.

10. The washing machine according to claim 9 wherein the effective volume of the reservoir is at least 20 mL.

11. A washing machine comprising:

a cabinet having a vertical orientation during normal operation;

a tub located in the cabinet and defining an interior and having a sump;

a wash basket located within the interior of the tub and defining a laundry treating space;

a pressure sensor located in the cabinet;

a hose having one end coupled with the pressure sensor; and an air trap comprising:

an air trap housing having a top wall and a bottom wall connected by opposing walls to define a chamber having an inlet in communication with the sump and an outlet in communication with the hose; and at least one baffle extending from the top wall to the bottom wall, and partially extending from one of the opposing walls toward the other of the opposing walls to define a gap therebetween and to substantially block water from entering the outlet when the cabinet is in a horizontal orientation.

12. The washing machine according to claim 11, and further comprising multiple baffles extending from the top wall to the bottom wall and partially extending from one of the opposings walls toward the other of the opposing walls substantially block water from entering the outlet when the cabinet is in a horizontal orientation.

13. The washing machine according to claim 12 wherein at least one of the baffles extends from a different opposing wall thereof at least one other of the baffles.

14. The washing machine according to claim 11 wherein the at least one baffle comprises an L-shape.

15. The washing machine according to claim 11 wherein the air trap housing has an inlet portion defining the inlet, and the inlet portion is inclined from horizontal when the washing machine is in a vertical orientation for normal operation such that water in the chamber will drain into the sump.

16. The washing machine according to claim 11 wherein the washing machine is a one of a horizontal axis washing machine and a vertical axis washing machine.

17. The washing machine according to claim 16 wherein the washing machine is a horizontal axis washing machine and further comprises at least one lifter located within the laundry treating space.

18. The washing machine according to claim 11 wherein the air trap housing comprises a reservoir defined in part by the at least one baffle, and the effective volume of the reservoir is greater than an expected amount of residual water in the sump after the washing machine has conducted a cycle of operation.

19. The washing machine according to claim 18 wherein the effective volume of the reservoir is at least 20 mL.

* * * * *